United States Patent [19]

Theriault

[11] Patent Number: 4,600,314

[45] Date of Patent: Jul. 15, 1986

[54] SMOKE DETECTOR CUTOFF TIMER

[76] Inventor: George E. Theriault, 23 Waverly Pl., New York, N.Y. 10003

[21] Appl. No.: 665,179

[22] Filed: Oct. 26, 1984

[51] Int. Cl.[4] ..... G04B 47/00

[52] U.S. Cl. ..... 368/10; 340/628; 340/527

[58] Field of Search ..... 340/628–630, 340/527; 368/10

[56] References Cited

U.S. PATENT DOCUMENTS

| | | | |
|---|---|---|---|
| 3,979,664 | 9/1976 | Harris | 324/397 |
| 4,313,110 | 1/1982 | Subulak et al. | 340/309.6 |
| 4,383,251 | 5/1983 | Perelli et al. | 340/309.6 |

*Primary Examiner*—Bernard Roskoski

*Attorney, Agent, or Firm*—Richard L. Miller

[57] ABSTRACT

A mountable remote cutoff timer for a smoke detector that is powered by a battery and includes a timer that is operatively connected to the battery, a light emitting device for indicating improper connection of the battery, and VELCRO® for attaching the mountable cutoff timer to the wall.

4 Claims, 3 Drawing Figures

Fig. 1
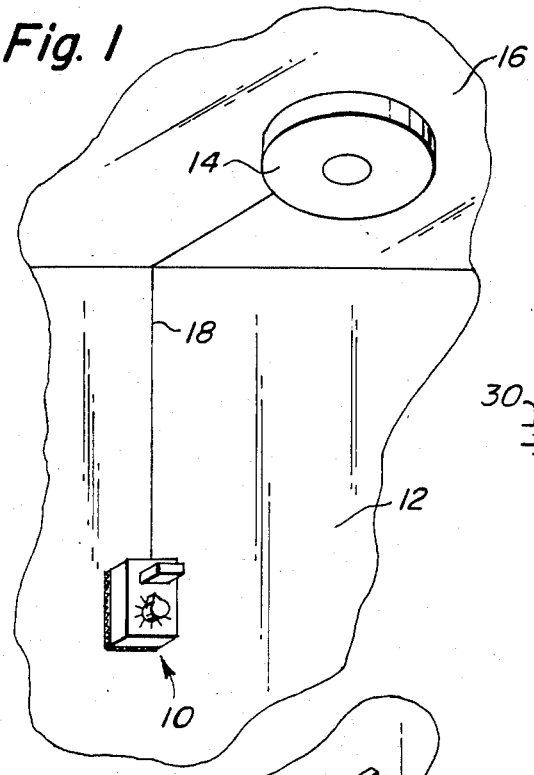
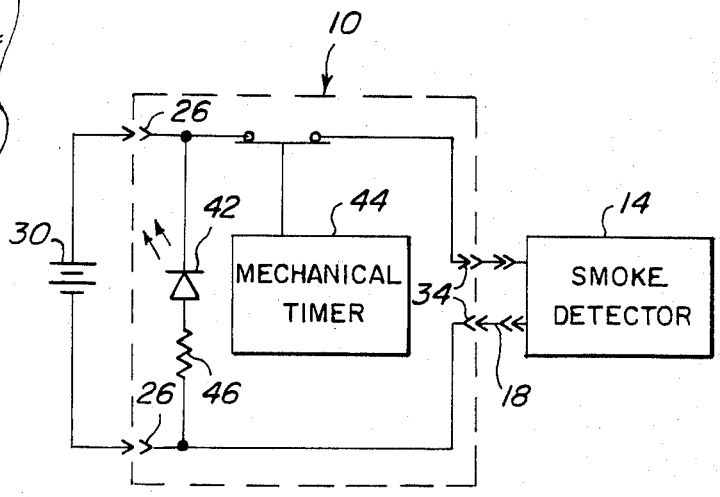
Fig. 3
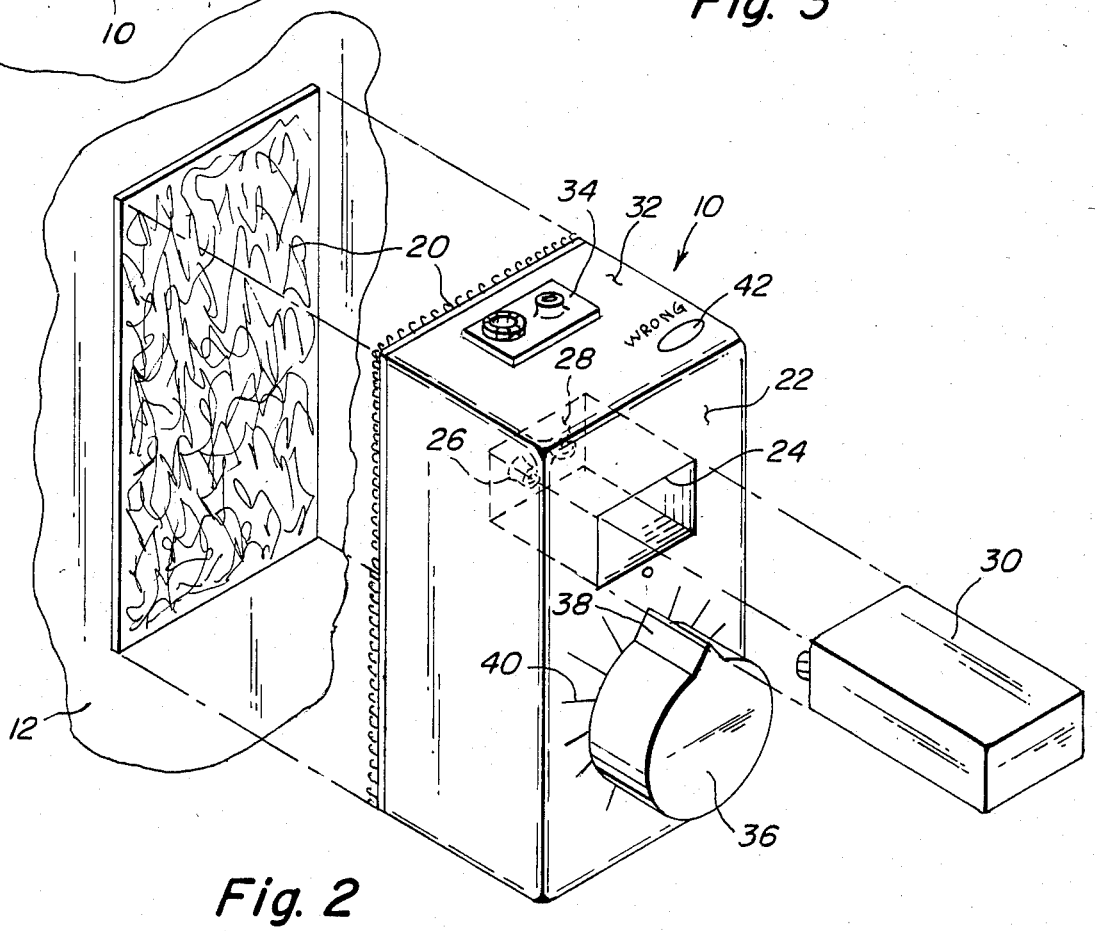
Fig. 2

SMOKE DETECTOR CUTOFF TIMER

BACKGROUND OF THE INVENTION

The present invention relates to smoke detector devices. More particularly, it relates to smoke detector devices that are powered by an internally mounted battery.

Smoke detector devices of the above-mentioned general type are known in the art. Smoke detectors are relatively small devices that mount on the ceiling and are triggered off by the ionization of the air caused by the presence of smoke. Thus, the smoke detector has proved to be a valuable warning against fire.

However, since the smoke detector is triggered off by smoke and not by the fire proper, a lot of other smoke creating situations, that are not caused by fire, can trigger off the detector. For instance, an abundance of cigarette smoke, some burnt cooking, etc. Thus, false indicators of fire will trigger off the smoke detector erroneously and cause an audible sound and possible panic.

SUMMARY OF THE INVENTION

Accordingly, it is the primary object of the present invention to provide a smoke detector cutoff timer that avoids the disadvantages of the prior art.

Another object of the present invention is to provide a smoke detector cutoff timer that is mounted by VELCRO® in a position remote from the smoke detector and that which is within easy reach.

Yet another object of the present invention is to provide a smoke detector cutoff timer that contains the battery to power the smoke detector so as to allow for simple replacement of burnt out batteries.

Still another object of the present invention is to provide a smoke detector cutoff timer that can inactivate the smoke detector for a predetermined period of time.

Yet still another object of the present invention is to provide a smoke detector cutoff timer that has a light emitting diode that lights if the replacement battery is inserted incorrectly with respect to polarity.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view illustrating the invention in use.

FIG. 2 is an enlarged partially exploded perspective view.

FIG. 3 is an electrical schematic diagram of the invention.

DETAILED DESCRIPTION OF THE PREFERRED EMBODIMENT

Referring now to FIG. 1, the smoke detector cutoff timer is shown generally at 10, mounted to a wall 12, and connected to a smoke detector 14 mounted on a ceiling 16. The smoke detector cutoff timer 10 is electrically connected to the smoke detector 14 by a cable 18.

As shown in FIG. 2, the smoke detector cutoff timer 10 is mounted to the wall 12 by the use of VELCRO® 20. The smoke detector cutoff timer 10 is substantially box shaped and has a front face 22 that contains a recess 24 that is provided with a battery connector 26 at its rear face 28. The recess 24 is formed to receive a battery 30 which powers the smoke detector 14. The smoke detector cutoff timer 10 further has a top face 32 that has a connector 34 mounted to it. The cable 18 connects to the connector 34.

Additionally, disposed on the front face 22 is a timer knob 36 with a pointer 38 that is movable through a plurality of markings 40 also disposed on the front face 22. Thus, the timer knob can be set in a number of different positions so as to vary the predetermined delay time.

Additionally, disposed on the top face 22 is an optional light emitting diode 42 or any other light emitting device with the word "WRONG" inscribed above it. If the battery 30 is inserted incorrectly into the recess 24, that is, the connectors of the battery 30 do not mate with the connector 26, the light emitting diode 42 will light and indicate a wrong connection. This will advise the user to remove the battery 30, reverse its connector position, and reinsert it correctly so that the respective connectors mate.

The schematic for the circuitry of the smoke detector cutoff timer 10 is shown in FIG. 3. The smoke detector 14 is connected to the smoke detector cutoff timer 10 by the cable 18 and the connectors 34. Internally mounted to the smoke detector cutoff timer 10 is a mechanical timer 44 which mechanically opens and closes the circuit between the battery 30 and the smoke detector 14. This allows the smoke detector 14 to be deactivated from a remote position for a predetermined length of time. Connected in parallel to the battery 30 is the light emitting diode 42 with a dropping resistor 46 as is well known in the art. This allows for the correct polarity connection of the battery 30 since its connectors, connect with connectors 26 which are recessed and not readily visible.

It is to be specifically understood that although a mechanical timer 44 is thus far illustrated in this specification that there are numerous electro-mechanical, and completely electronic timers which could be used with equally sufficient results, and these timer could even be powered by the same battery 30, which powers the smoke detector 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A smoke detector system having a smoke detector and a mountable remote cutoff timer for said smoke detector, that controls power from a battery, said timer comprising:

a unit separate and remotely disposed from, but with electrical connected means to, the smoke detector;

a timer contained within said unit;

battery coupling means within said unit for receiving the battery which can remotely energize the smoke detector, said timer capable of disengaging the battery from energization of the smoker detector for a selected period of time; and indicator means on said unit for indicating improper connection of the battery to the unit.

2. The remote timer as defined in claim 1, wherein said indicator means includes a polarity sensitive light emitting device mounted to said unit.

3. The remote timer as defined in claim 1; further comprising means for mounting the remote timer to a wall.

4. The remote timer as defined in claim 3, wherein said means includes VELCRO®.

* * * * *